US007040946B2

(12) United States Patent
Joo et al.

(10) Patent No.: US 7,040,946 B2
(45) Date of Patent: May 9, 2006

(54) PLASMA DISPLAY PANEL AND MANUFACTURING METHOD THEREOF

(75) Inventors: Young Dae Joo, Daegu-si (KR); Tae Wan Choi, Gyeongsangbuk-do (KR); Seung Tea Park, Gyeongsangbuk-do (KR); Soon Hak Kim, Gyeongsangbuk-do (KR); Seok Dong Kang, Gyeongsangbuk-do (KR); Sang Tae Kim, Daegu-si (KR); Hyoung Kyun Bae, Daegu-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/751,644

(22) Filed: Jan. 6, 2004

(65) Prior Publication Data

US 2004/0142623 A1 Jul. 22, 2004

Related U.S. Application Data

(62) Division of application No. 10/286,918, filed on Nov. 4, 2002, now Pat. No. 6,838,828.

(30) Foreign Application Priority Data

| | | |
|---|---|---|
| Nov. 5, 2001 | (KR) | 2001-68674 |
| Nov. 5, 2001 | (KR) | 2001-68675 |
| Nov. 5, 2001 | (KR) | 2001-68676 |
| Nov. 6, 2001 | (KR) | 2001-69011 |
| Nov. 6, 2001 | (KR) | 2001-69012 |

(51) Int. Cl.
*H01J 9/00* (2006.01)

(52) U.S. Cl. ..... 445/24; 445/25

(58) Field of Classification Search ..... 445/23–25
See application file for complete search history.

(56) References Cited

U.S. PATENT DOCUMENTS

| | | | | |
|---|---|---|---|---|
| 4,854,936 | A | 8/1989 | Ono et al. | |
| 6,075,319 | A * | 6/2000 | Kanda et al. | 313/584 |
| 6,156,433 | A * | 12/2000 | Hatori et al. | 428/411.1 |
| 6,465,956 | B1 * | 10/2002 | Koshio et al. | 313/586 |
| 6,650,051 | B1 * | 11/2003 | Park et al. | 313/582 |
| 2001/0017520 | A1 | 8/2001 | Masuda et al. | |

FOREIGN PATENT DOCUMENTS

| | | |
|---|---|---|
| CN | 1289140 | 3/2001 |
| EP | 0 704 183 | 10/1996 |
| EP | 1 406 288 | 4/2004 |
| JP | 10-40821 | 2/1998 |
| JP | 10-92325 | 4/1998 |
| JP | 11-329257 | 11/1999 |
| JP | 2000-156166 | 6/2000 |
| JP | 2000-251744 | 9/2000 |

* cited by examiner

*Primary Examiner*—Joseph Williams
(74) *Attorney, Agent, or Firm*—Fleshner & Kim, LLP

(57) ABSTRACT

The present invention relates to plasma display panel and manufacturing method thereof to simplify the manufacturing steps and reduce cost of production. In the present invention, a black layer formed between a transparent electrode and a bus electrode is formed together with a black matrix at the same time. In this case, the black layer is formed together with the black matrix in one. Cheap non-conductive oxide is used as a black powder of a black layer. Specifically, in case the black layer and the black matrix are formed in one, the bus electrode is shifted to a non-discharge area to improve the brightness of the plasma display panel.

48 Claims, 12 Drawing Sheets

PLASMA DISPLAY PANEL AND MANUFACTURING METHOD THEREOF

This application is a Divisional of application Ser. No. 10/286,918 filed Nov. 4, 2002, now U.S. Pat. No. 6,838,828. The entire disclosure of the prior application is considered as being part of the disclosure of the accompanying application and is hereby incorporated by reference therein. This application claims priority to of Application Ser. Nos. 68674/2001 filed on Nov. 5, 2001, in Korea; 68675/2001 filed on Nov. 5, 2001, in Korea; 68676/2001 filed on Nov. 5, 2001, in Korea; 69011/2001 filed on Nov. 6, 2001, in Korea; and 69012/2001 filed on Nov. 6, 2001, in Korea is claimed under 35 U.S.C. 119.

BACKGROUND OF THE INVENTION

1. Field of the Invention

The present invention relates to a plasma display panel and manufacturing method thereof, and more particularly, to a front substrate of a plasma display panel capable of concurrently forming a black layer placed within a discharge and a black matrix placed between discharge cells.

2. Background of the Prior Art

In general, plasma display panel (hereafter, referred to as PDP) is a display device using the visible rays generated when vacuum ultraviolet rays generated by gas discharge excite phosphor.

The PDP is thinner in thickness and lighter in weight than the cathode ray tubes (CRTs) that have been mainly employed as display devices. The PDP has an advantage in that a high definition and large-sized screen can be realized.

The PDP having such advantages described above includes many discharge cells arranged in matrix fashion, and each of the discharge cells forms one pixel of a screen.

FIGS. 1 and 2 show a structure of a general plasma display panel respectively. As shown in FIGS. 1 and 2, the plasma display panel includes a front substrate 10 on which an image is display and a rear substrate 20 spaced from the front substrate 10 with a predetermined interval and facing the front substrate 10. A plurality of sustain electrodes 11 are arranged in parallel on the front substrate 10. The sustain electrode 11 consists of a transparent electrode 11*a* and a bus electrode 11*b*. The transparent electrode 11*a* is made of ITO (Indium Tin Oxide) and the bus electrode 11*b* is made of conductive material such as silver. The bus electrode 11*b* is formed on the transparent electrode 11*a*.

Generally, it is well known that silver (Ag) constituting the bus electrodes cannot transmit the light generated by discharge but reflects external lights. Such silver makes the plasma display worse in its contrast. To overcome this problem, a black electrode 11*c* is formed between the transparent electrode 11*a* and the bus electrode 11*b* to enhance contrast. A dielectric layer 12 limits discharge current and is coated on the sustain electrode 11. The dielectric layer 12 insulates a pair of the electrodes from each other. A protective layer 13 is formed on the dielectric layer 12 to make discharge condition better. Magnesium oxide (MgO) is deposited on the protective layer 13.

As shown in FIG. 2, a black matrix 14 is arranged between discharge cells. The black matrix 14 performs a light screening function to absorb external lights generated outside the front substrate 10 and reduce the reflection and a function to enhance the purity of the front substrate 10 and contrast. Stripe type (well type) barrier ribs 21 are arranged in parallel with each other on the rear substrate 20 to form a plurality of discharge spaces, e.g., discharge cells. A plurality of address electrodes 22 are arranged in parallel with the barrier rib and perform address discharge at the location where the address electrodes 22 cross over the sustain electrodes 11

RGB phosphorous layer 23 that is excited by the vacuum ultraviolet ray generated by a discharge cell and emits visible rays is coated inside the barrier rib 21. A lower dielectric 24 is formed on the rear substrate 20 and the entire surface of the address electrode 22 by annealing.

A method of manufacturing a front substrate of the conventional plasma display panel structured as above will be described.

FIGS. 3A through 3G show a method of manufacturing a front substrate of the conventional plasma display panel. As shown in FIGS. 3A through 3G, a transparent electrode 11*a* of ITO (Indium Tin Oxide) is formed on the front substrate 10. A black paste is printed on the front substrate 10 including the transparent electrode 11*a* and dried at a temperature of about 120° C. to form a black electrode layer as shown in FIG. 3A. Afterwards, a silver (Ag) paste is printed thereon and dried to form a bus electrode 11*b* as shown in FIG. 3B. The silver (Ag) paste is exposed to the ultraviolet ray using a first photomask 30 as shown in FIG. 3C. The exposed silver paste is developed and annealed in an annealing furnace (not shown in FIG. 3D) at a temperature of about 550° C. or higher for about three hours or more as shown in FIG. 3D. Thereafter, a dielectric paste is printed on the developed silver paste and dried as shown in FIG. 3E. Afterwards, a black matrix 14 is printed on a non-discharge area between discharge cells as shown in FIG. 3F. The dielectric layer and the black matrix ate concurrently annealed in the annealing furnace (not shown in FIG. 3G) at a temperature of 550° C. or higher for about three hours or more as shown in FIG. 3G.

As described above, when manufacturing the front substrate of the conventional plasma display panel, the bus electrode 11*b* is formed by a total of three printing and drying processes that are performed once for each of black electrode layer 11*c*, bus electrode 11*b* and black matrix 14 and two annealing processes. To this end, the manufacturing process is too long and production costs are increased.

On the other hand, in general, it is desired that the interval between the bus electrodes in discharge cell is distant as possible as to enlarge the discharge space to improve the brightness. However, as the manufacturing method of FIG. 3, the bus electrode is formed only on the transparent electrode in the discharge cell, so that it is limited to enlarge the interval between the bus electrodes in the convention plasma display panel. If the bus electrode is formed on the non-discharge area, the silver (Ag) particle of the bus electrode migrates and bonds with the lead particle of the front substrate to change the color of the bus electrodes and lower the color temperature of the printed destination panel, which results in sudden reduction of brightness. In addition, silver particles of the bus electrode migrate to cause insulating destruction.

Accordingly, in the conventional plasma display panel, the bus electrode is formed on the transparent electrode in the discharge cell, so that improvement of the brightness depending on enlarging the interval between the bus electrodes is limited. Even though the bus electrode is formed on the non-discharge area with a predetermined interval, the silver (Ag) particle's migration changes the color of the bus electrode to lower the brightness.

SUMMARY OF THE INVENTION

The object of the present invention is to overcome the problem and the disadvantage described above.

Accordingly, it is an object of the present invention to provide a plasma display panel and a method thereof to simplify the manufacturing process by concurrently forming the black layer and the black matrix.

It is another object of the present invention to provide a plasma display panel and a method thereof to improve the brightness of the plasma display panel by forming a portion of the bus electrode on non-discharge area.

It is a further object of the present invention to provide a plasma display panel and a method thereof to reduce the cost of production and prevent adjacent discharge cells from having a short-circuit with each other by using a conductive and cheap nonconductive black powder.

To achieve these objects and other advantages and in accordance with the purpose of the invention, as embodied and broadly described herein, a preferred embodiment of the present invention provides a plasma display panel comprising: a front substrate; a rear substrate arranged by a predetermined interval from the front substrate; a plurality of sustain electrodes arranged in parallel with each other on the front substrate; a plurality of data electrodes arranged in a direction perpendicular the plurality of sustain electrodes on the rear substrate; and a plurality of barrier ribs arranged at a constant interval between the front substrate and the rear substrate to partition discharge cells; wherein each of the sustain electrodes includes: a transparent electrode; and a bus electrode arranged on the transparent electrode, wherein a black layer is formed between the transparent electrode and the bus electrode to enhance contrast such that the black layer covers an entire surface of the front substrate exposed to a non-discharge area between the discharge cells.

The black layer formed on the non-discharge area is a black matrix. The bus electrode is formed only on the black layer formed on the transparent electrode in the discharge cell or the bus electrode is formed on an area extending from a part of the black layer formed on the transparent electrode in the discharge cell to a part of the black layer formed on the non-discharge area. The black layer includes a black powder made of at least one selected from the group consisting of cobalt (Co) based oxides, chromium (Cr) based oxides, manganese (Mn) based oxides, copper (Cu) based oxides, iron (Fe) based oxide and carbon (C) based oxides. The black layer contains a frit glass having a high softening point of 450° C. or more, the frit glass including at least one selected from the group consisting of $PbO—B_2O_3—Bi_2O_3$, $ZnO—SiO_2—Al_2O_3$ and $PbO—B_2O_3—CaO—SiO_2$.

Another preferred embodiment of the present invention provides a plasma display panel comprising: a front substrate; a rear substrate arranged by a predetermined interval from the front substrate; a plurality of sustain electrodes arranged in parallel with each other on the front substrate; a plurality of data electrodes arranged in a direction perpendicular the plurality of sustain electrodes on the rear substrate; and a plurality of barrier ribs arranged at a constant interval between the front substrate and the rear substrate to partition discharge cells, wherein each of the sustain electrodes includes: a transparent electrode; and a bus electrode formed on the transparent electrode, wherein a black layer is formed between the transparent electrode and the bus electrode to enhance contrast, wherein a black matrix is formed between the discharge cells, wherein the black layer and the black matrix are formed at a same height from the front substrate and made of a same material.

The black layer and the black matrix are formed simultaneously by the same process. The black layer is spaced by a short interval from the black matrix to extend to a part of a non-discharge area between the discharge cells.

Another preferred embodiment of the present invention provides a method of manufacturing a plasma display panel including a front substrate; a rear substrate arranged by a predetermined interval from the front substrate; a plurality of sustain electrodes arranged in parallel with each other on the front substrate; a plurality of data electrodes arranged in a direction perpendicular the plurality of sustain electrodes on the rear substrate; and a plurality of barrier ribs arranged at a constant interval between the front substrate and the rear substrate to partition discharge cells, the method comprising the steps of: (a) forming the plurality of transparent electrodes in parallel with each other on the front substrate; (b) coating a black paste on an entire surface of the front substrate on which the plurality of transparent electrodes are formed, and drying the coated black paste; (c) exposing an area where a black layer is being formed using a first photomask; (d) coating a bus electrode paste on the exposed black paste and drying the coated bus electrode paste; (e) exposing an area where a bus electrode is formed using a second photomask; (f) developing and annealing the exposed front substrate to form the black layer and the bus electrode; and (g) coating a dielectric paste on the entire surface of front substrate on which the black layer and the bus electrode is formed, and drying the coated dielectric paste.

The first photomask has a pattern such that the black layer is formed on an area extending from the transparent electrode in one discharge cell to a transparent electrode in an adjacent discharge cell via non-discharge area between the discharge cells. It is desirable that the black layer formed on the non-discharge area is a black matrix. The second photomask has a pattern that the bus electrode is formed in a same size as the black layer formed on the transparent electrode in one discharge cell. Or the second photomask has a pattern such that the bus electrode is formed on an area extending from a part of the black layer formed on the transparent electrode in the discharge cell to a part of the black layer formed on the non-discharge area.

Another preferred embodiment of the present invention provides a method of manufacturing a plasma display panel including: a front substrate; a rear substrate arranged by a predetermined interval from the front substrate; a plurality of sustain electrodes arranged in parallel with each other on the front substrate; a plurality of data electrodes arranged in a direction perpendicular the plurality of sustain electrodes on the rear substrate; and a plurality of barrier ribs arranged at a constant interval between the front substrate and the rear substrate to partition discharge cells, the method comprising the steps of: (a) forming the plurality of transparent electrodes in parallel with each other on the front substrate; (b) coating a black paste on the entire surface of the front substrate on which the plurality of transparent electrodes are formed, and drying the coated black paste; (c) exposing an area where a black matrix is being formed using a first photomask; (d) coating a bus electrode paste on the exposed black paste and drying the coated bus electrode paste; (e) exposing an area where a bus electrode is being formed using a second photomask; (f) developing and annealing the exposed front substrate to form the black matrix and the bus electrode; and (g) coating a dielectric paste on the entire surface of the front substrate on which the black layer and the bus electrode is formed, and drying the coated dielectric paste.

The black layer is formed extending from the transparent electrode formed in a discharge cell to a part of a non-discharge area between the discharge cell and an adjacent discharge cell. The black layer is formed simultaneously in step (e) exposing areas where the bus electrode is being formed.

Another preferred embodiment of the present invention provides a method of manufacturing a plasma display panel including: a front substrate; a rear substrate arranged by a predetermined interval from the front substrate; a plurality of sustain electrodes arranged in parallel with each other on the front substrate; a plurality of data electrodes arranged in a direction perpendicular the plurality of sustain electrodes on the rear substrate; and a plurality of barrier ribs arranged at a constant interval between the front substrate and the rear substrate to partition discharge cells; the method comprising the steps of: (a) forming the plurality of transparent electrodes in parallel with each other on the front substrate; (b) coating a black paste on the entire front substrate on which the plurality of transparent electrodes are formed, and drying the black paste; (c) exposing an area where a black layer and a black matrix is being formed using a first photomask; (d) coating a bus electrode paste on the exposed black paste and drying the coated bus electrode paste; (e) exposing an area where a bus electrode is being formed using a second photomask; (f) developing and annealing the exposed front substrate to form the black matrix and the bus electrode by; and (g) coating a dielectric paste on the entire surface of the front substrate on which the black layer and the bus electrode is formed, and drying the dielectric paste.

The black layer and the black matrix are concurrently formed.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE PREFERRED EMBODIMENTS

Reference will now be made in detail to a preferred embodiment of the present invention. For convenient explanation, the references used in description of the prior art will be used hereafter for the members of the present invention corresponding to those of the prior art.

Figure 1:
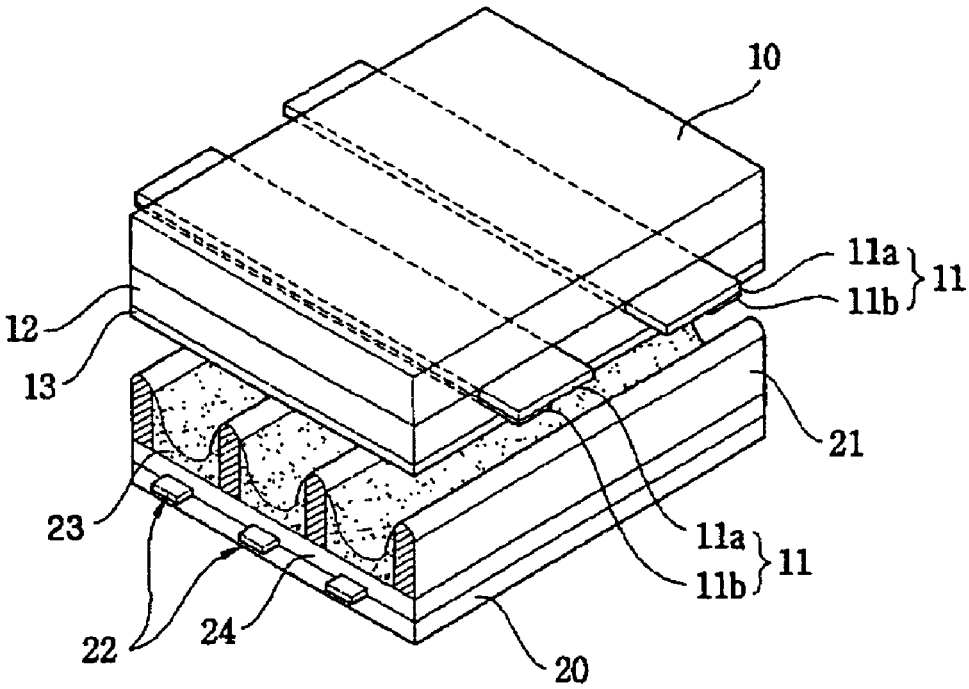
Fig.1 (Related Art)
FIG. 1 shows a structure of a general plasma display panel.
Figure 2:
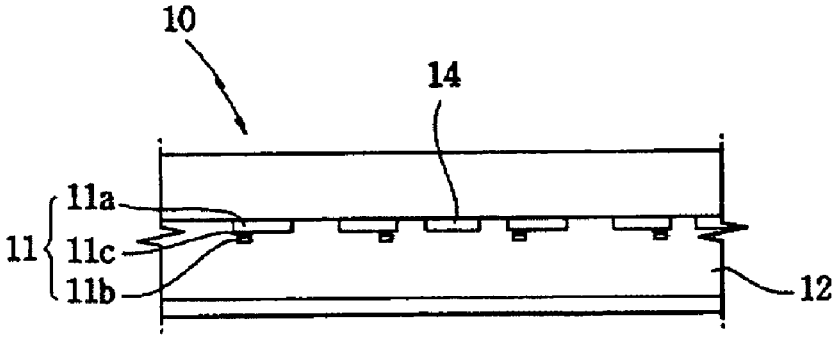
Fig.2 (Related Art)
FIG. 2 shows a structure of a front substrate of the plasma display panel of FIG. 1.
Figure 3A:
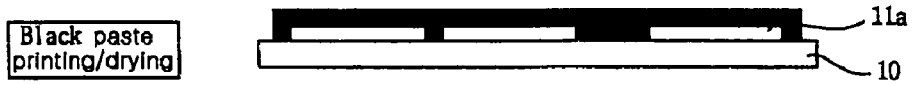
Fig.3A (Related Art)
FIGS. 3A through 3G show a method of manufacturing a front substrate of the plasma display panel of FIG. 2.
Figure 3B:
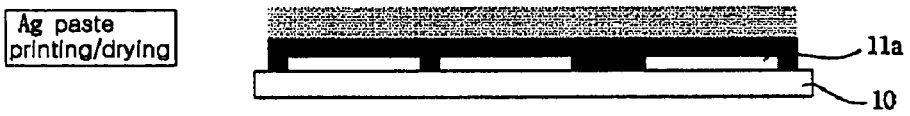
Fig.3B (Related Art)
Figure 3C:
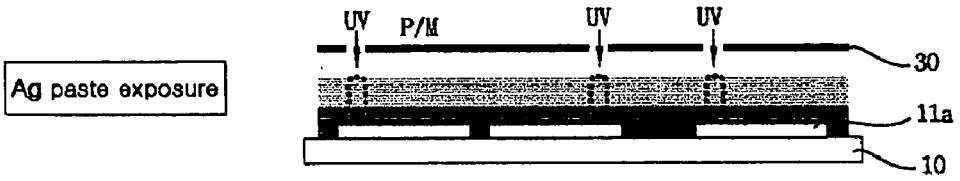
Fig.3C (Related Art)
Figure 3D:
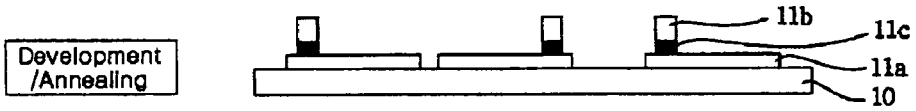
Fig.3D (Related Art)
Figure 3E:
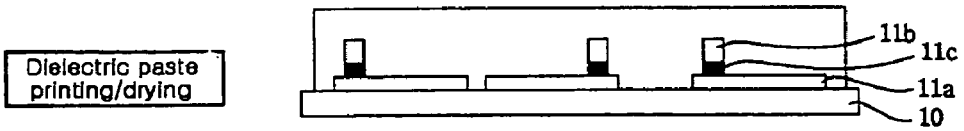
Fig.3E (Related Art)
Figure 3F:
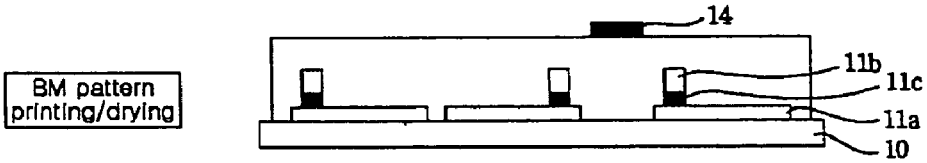
Fig.3F (Related Art)
Figure 3G:
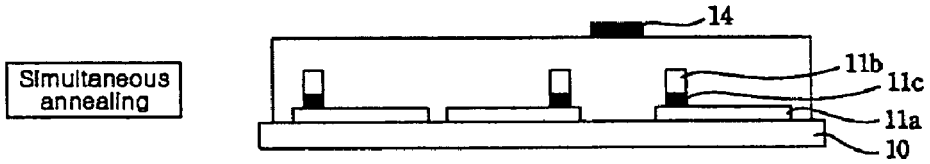
Fig.3G (Related Art)
Figure 4:
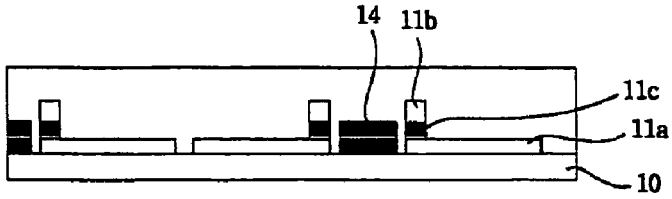
FIG. 4 is shows a structure of a front substrate of the plasma display panel according to a first embodiment of the present invention.

FIG. 4 shows the structure of the front substrate of the plasma display panel according to the first preferred embodiment of the present invention. Referring to FIG. 4, a black matrix 14 and a black layer 11*c* are formed at the same time on the front panel 10 of the plasma display panel. In other words, a black paste is coated on the entire surface of the front panel 10 having a transparent electrodes 11*a*, dried and exposed to ultraviolet ray using a photomask to form the black layer 11*c* and the black matrix 14. In this time, the photomask has a pattern formed deliberately to form the black layer 11*c* and the black matrix 14.

Accordingly, as described above, the black layer 11*c* and the black matrix 14 are formed simultaneously by an exposure process using the patterned photomask. So, the black layer 11*c* and the black matrix 14 are formed to have the same height from the front substrate 10. The black layer 11*c* and the black matrix 14 are formed of the same material since the black paste can be coated entirely on the front panel 10 and dried.

A method for fabricating the structure of the front substrate of the plasma display panel is depicted in FIGS. 5A to 5F. FIGS. 5A to 5F show the front substrate of the plasma display panel.

Figure 5A:
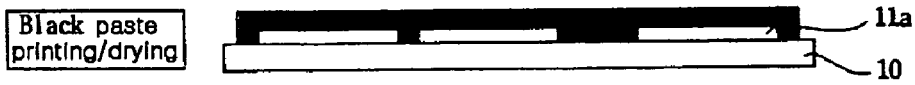
FIGS. 5A through 5F show a method of manufacturing a front substrate of the plasma display panel of FIG. 4.

First, the black paste is coated on the front substrate 10 by a printing process and dried by a dry process as shown in FIG. 5A. In this case, a plurality of the transparent electrodes 11*a* were formed on the front substrate 10 deliberately.

Figure 5B:
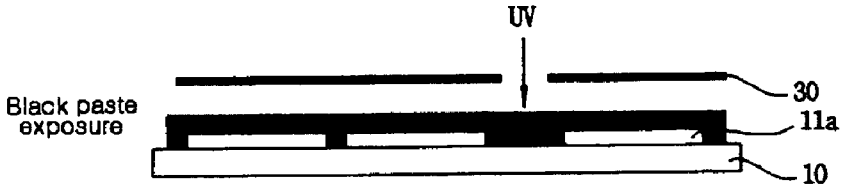

The front substrate 10 which the black paste is coated on and dried is exposed to the ultraviolet ray using a first photomask 30 to form a pattern on the area which a black matrix is formed on as shown in FIG. 5B.

Figure 5C:
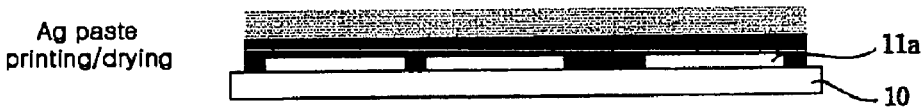

A silver (Ag) paste is coated on the front substrate 10 that is exposed to the ultraviolet ray, and dried as shown in FIG. 5C.

Figure 5D:
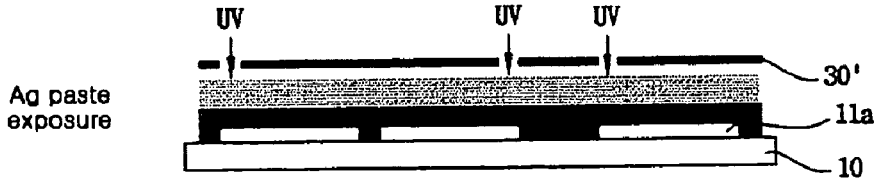

The front substrate 10 which the silver (Ag) paste is coated on and dried is exposed to the ultraviolet ray using a second photomask 30' to form a pattern on the area which bus electrodes are being formed as shown in FIG. 5D.

Figure 5E:
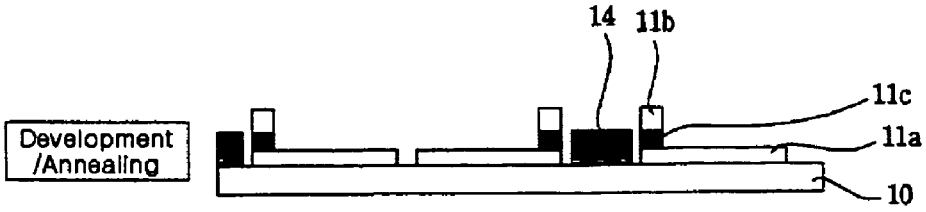

The front substrate 10 which is exposed to the ultraviolet ray is developed using a developing solution and an annealing process is performed to the front substrate 10 to form a black matrix 14 and bus electrodes 11*b* as shown in FIG. 5E.

Figure 5F:
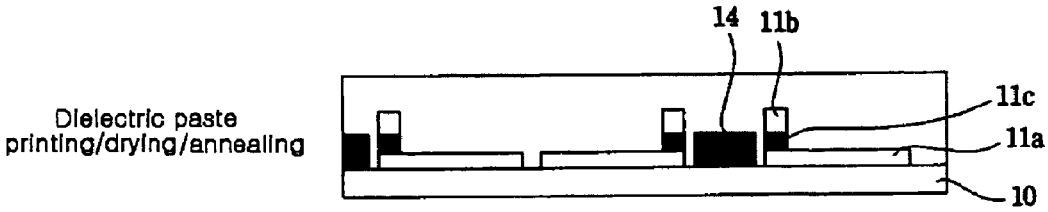

A dielectric paste is coated on the front substrate 10 that the black matrix 14 and the bus electrodes 11*b* are formed on and dry and annealing processes are performed on the front substrate 10 as shown in FIG. 5F.

As described in the manufacturing process of FIGS. 5A through 5F, since the black layer 11*c* and the black matrix 14 are formed at once using the first photomask 30, the present invention simplifies the manufacturing process in comparison with that of the related art in which the black layer 11*c* and the black matrix 14 are formed separately. In other word, in comparison with the related art, the present invention omits the step of forming the black matrix separately, reduces the material cost, the photomask and the cleaning solution for forming the black matrix and does not need a printer and a dryer used in forming the black matrix.

In the aspect of panel quality, the misalignment due to using a photomask to form a black matrix separately in the related art is avoided. In the present invention, since the black layer and the black matrix can be formed at once in batch, the pattern characteristic of the black matrix is improved.

Figure 6:
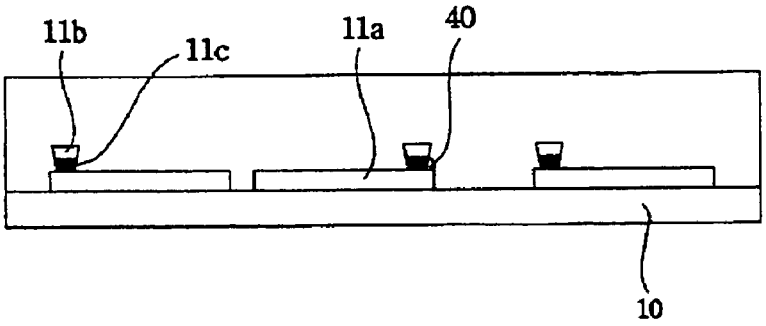
FIG. 6 depicts an undercut on a bus electrode when manufacturing a front substrate of the plasma display panel of FIGS. 5A through 5F.

In the manufacturing process of FIGS. 5A through 5F, the black layer 11*c* is formed only by exposing the silver (Ag) paste coated on the black paste without performing additional exposure process. The black layer 11*c* is formed between a transparent electrode 11*a* and a bus electrode 11*b*. If the black layer 11*c* is not exposed to the ultraviolet ray directly but the area where the bus electrode is being formed is exposed to the ultraviolet ray later, the developing solution leaks into the black layer when developing the area where the bus electrode will be formed. This leads to undercut phenomenon in which the lower portion of the black layer 11*c* is overetched as shown in FIG. 6. The undercut makes the shape of the bus electrode to be changed into edge curl shape in the annealing process or cause air bubbles to be generated at electrodes since a dielectric is not filled in the edge curl portion when coating the dielectric paste on the bus electrode. The air bubbles results in cell defect, insulating destruction, etc.

A manufacturing method of the front substrate of the plasma display panel to prevent undercut is described in FIGS. 7A through 7F. FIGS. 7A through 7F show the manufacturing method of the front substrate of the plasma display panel to prevent undercut of bus electrodes.

Figure 7A:
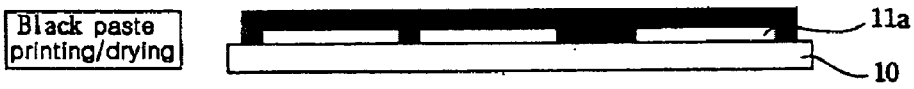
FIG. 7A though 7F show a method of manufacturing a front substrate of the plasma display panel to prevent the bus electrode from undercut.
Figure 7B:
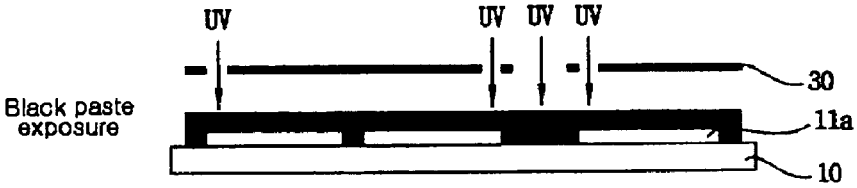

Referring to FIGS. 7A through 7F, after a black paste is coated on a front substrate 10 having a plurality of transparent electrodes in a print/dry process as shown in FIG. 7A, the black paste is exposed using a first photomask 30 to form a pattern on the area that a black layer and a black matrix will be formed as shown in FIG. 7B. In this case, a pattern is deliberately formed on the first photomask 30 to expose the area where the black layer and the black matrix will be formed.

Figure 7C:
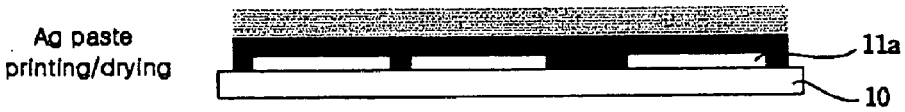
Figure 7D:
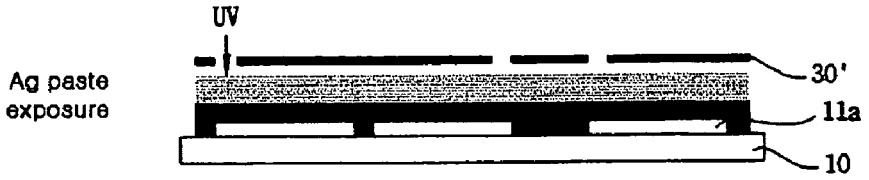
Figure 7E:
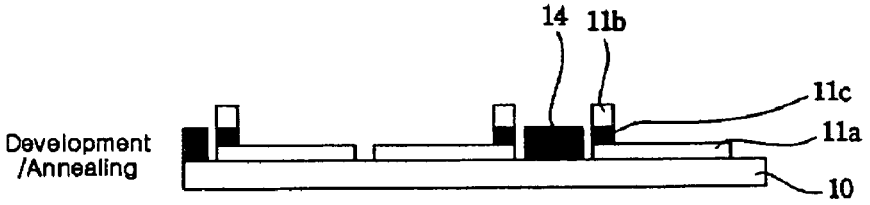

After a silver (Ag) paste is coated on the exposed front substrate 10 in a print/dry process as shown in FIG. 7C, the silver paste is exposed using a second photomask 30' to form a pattern on the area where a bus electrode 11*b* will be formed as shown in FIG. 7D. A black matrix 14 and a bus electrode 11*b* are formed in a developing and annealing process as shown in FIG. 7E.

Figure 7F:
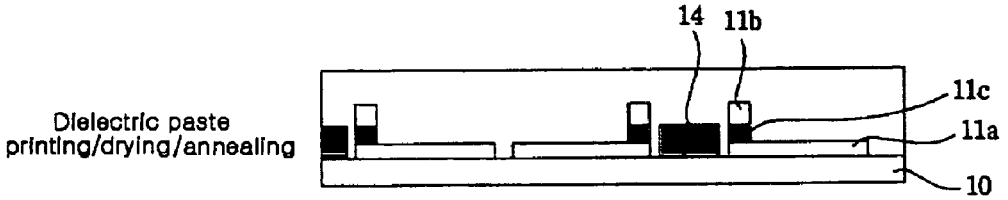

After performing print/dry process in which the dielectric paste is coated on the font substrate 10 on which the black matrix 14 and a bus electrode 11*b* are formed, the dielectric paste is annealed as shown in FIG. 7F. Accordingly, as shown in FIG. 7B, when exposing the area where the black matrix will be formed, the area where the black layer will be formed is exposed together during development, so that the leakage of the developing solution into the area of the black layer is prevented and thus the generation of the undercut is also prevented. The black layer 11*c* is formed together with the bus electrode 11*b* during the development. Accordingly, the black layer 11*c* is formed between the transparent electrode 11*a* and the bus electrode 11*b*.

As a result, as shown in FIGS. 7A through 7F, the areas where the black layer and the black matrix will be formed are exposed at once using the first photomask 30 where the patterns of the black layer and the black matrix are formed, so that the black layer 11*c* and the black matrix 14 can be formed at the same. In contrary with the method to expose only the area that a black matrix will be formed as shown in FIG. 5B, the area where a black matrix will be formed is exposed simultaneously together with the area where a black matrix will be formed, so that the undercut which may be generated during development can be avoided deliberately as shown in FIGS. 7A through 7F.

In the front substrate 10 of the plasma display panel manufactured by the method shown in FIGS. 7A through 7F, silver (Ag) particles are migrated and bonded with lead (Pb) particles on the front substrate 10 to change colors of the bus electrode 11*b*, so that the color temperature is lowered and the brightness degenerates. Silver (Ag) particles' migration may cause insulating destruction.

Figure 8:
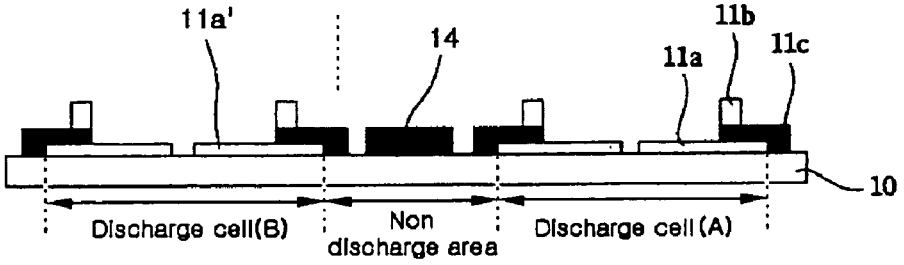
FIG. 8 is shows a structure of a front substrate of the plasma display panel according to a second embodiment of the present invention.

As described above, the structure of the front substrate of the plasma display panel to prevent the color of bus electrodes from changing due to silver (Ag) particles' migration is depicted by FIG. 8. FIG. 8 shows the structure of the front substrate of the plasma display panel according to second embodiment of the present invention. Referring to FIG. 8, the front substrate 10 of the plasma display panel according to a second embodiment of the present invention extends from a transparent electrode 11*a* to a part of the non-discharge area located between a discharge cell A and an adjacent discharge cell B. In this case, when it is assumed that the interval between the transparent electrode 11*a* in the discharge cell A and the transparent electrode 11*a*' in the adjacent discharge cell B is the same as that of FIG. 4, the width of the black matrix 14 is reduced as much as the black layer 11*c* extends to a part of the non-discharge area.

The method of fabricating the front substrate of the plasma display panel is the same as that of FIGS. 5A to 5F and 7A to 7F. To form the black layer including a part of the discharge area, it is required to manufacture the photomask that a pattern is deliberately formed such that the areas where the black layer and the bus electrode will be formed may be larger than those of FIGS. 5A to 5F and 7A to 7F.

Figure 9:
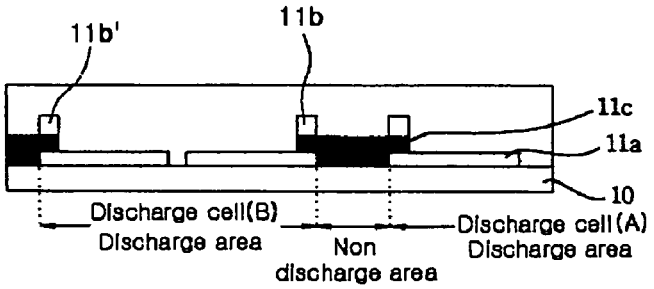
FIG. 9 is shows a structure of a front substrate of the plasma display panel according to a third embodiment of the present invention.

FIG. 9 shows the structure of the front substrate of the plasma display panel according to third embodiment of the present invention. In general, the front substrate of the plasma display panel includes the discharge area where discharges occur and the non-discharge area where discharges do not occur. The non-discharge area is the area formed between the discharge cell and its adjacent discharge cell where a pair of transparent electrodes 11*a* are formed.

On the front substrate 10 of the plasma display panel according to third embodiment of the present invention, the black layer 11*c* is formed between transparent electrodes 11*a* and 11*b* and coated on the non-discharge area between the discharge cells A and B. In this case, it is desirable that the black layer formed between the non-discharge areas is a black matrix. The previous embodiment of the present invention provides that the black layer is not spaced by a constant distance from a black matrix. However, in the third embodiment of the present invention, the black layer and the black matrix are not spaced but they are integrally formed. Also, the black layer and the black matrix are formed at once.

The method of manufacturing the front substrate of the plasma display panel according to third embodiment of the present invention will be described. FIGS. 10A through 10F shows the method of manufacturing the front substrate of the plasma display panel of FIG. 9.

Figure 10A:
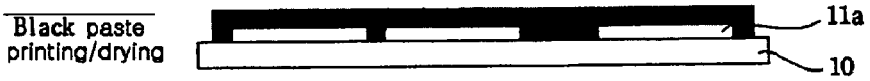
FIGS. 10A through 10F show a method of manufacturing a front substrate of the plasma display panel of FIG. 9.
Figure 10B:
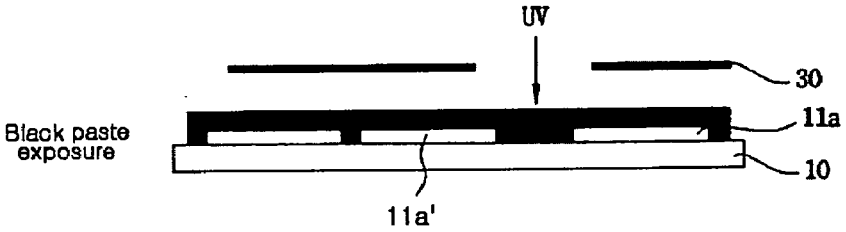
Figure 10C:
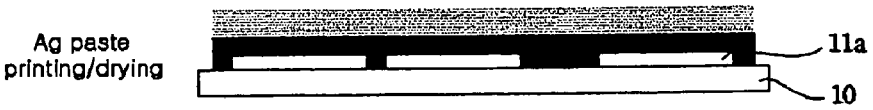
Figure 10D:
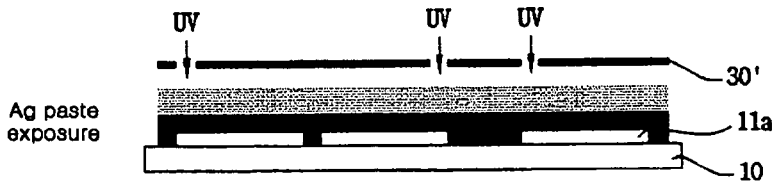
Figure 10E:
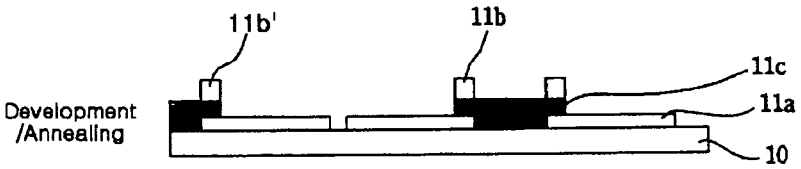
Figure 10F:
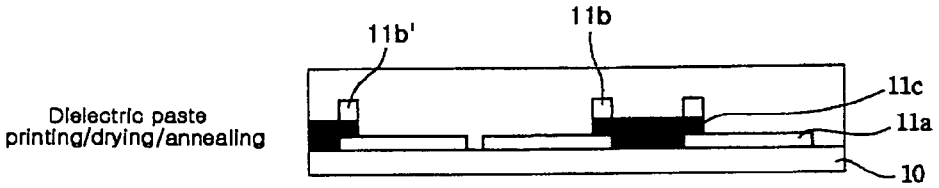

Referring to FIGS. 10A through 10F, a black paste is coated on the front substrate 10 where a plurality of transparent electrodes 11*a* are formed, as shown in FIG. 10A. The coated black paste is exposed using a first photomask 30 form a pattern on the area where a black layer will be formed, as shown in FIG. 10B. In this case, it is desirable that a pattern is deliberately formed on the first photomask 30 so as to expose the area between the transparent electrode 11*a* in the discharge cell A and the transparent electrode 11*a*' in the adjacent discharge cell B and including a portion of the transparent electrode 11*a* and a portion of the transparent electrode 11*a*'. A silver (Ag) paste is coated on the exposed front substrate 10 in print/dry process, as shown in FIG. 10C. The coated silver Ag paste is exposed using a second photomask 30' to form a pattern on the area where a bus electrode will be formed, as shown in FIG. 10D. The exposed front substrate 10 is developed by developing solution and annealed to form a black layer 11*c* and bus electrode 11*b*, as shown in FIG. 10E. After dielectric paste is coated on the front substrate 10 on which the black layer 11*c* and the bus electrode are formed, a dry and annealing process is performed, as shown in FIG. 10F.

As shown in FIGS. 9 and 10A through 10F, according to the third embodiment, the black layer and the black matrix are not formed separately but the black layer 11*c* formed between the transparent electrode 11*a* and the bus electrode 11*b* is formed to coat on the non-discharge area. In other words, the black layer 11*c* and the black matrix are formed in one at once to improve contrast and reduce cost of production.

Figure 11:
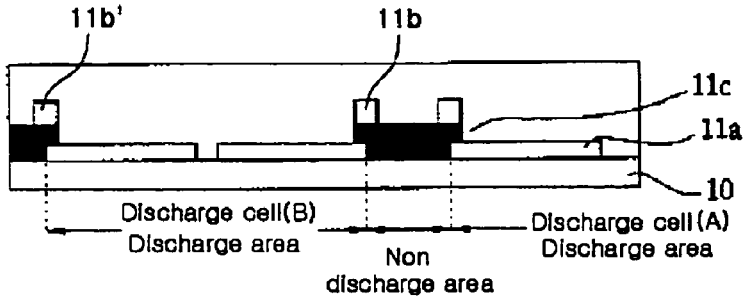
FIG. 11 is shows a structure of a front substrate of the plasma display panel according to a fourth embodiment of the present invention.

On the other hand, as shown in FIGS. 9 and 10A through 10F, the black layer is formed with the black matrix in one and the bus electrode 11*b* formed on the black layer is shifted to be formed on the non-discharge area so that the brightness can be improved. In other words, as described above, the interval between two bus electrodes 11*b* and 11*b*' in a discharge cell is so long using a non-discharge area as a boundary as to contribute to improvement of brightness. Accordingly, two bus electrodes 11*b* and 11*b*' in a discharge cell are formed on a portion of the adjacent non-discharge cell so that the interval between the bus electrodes 11*b* and 11*b*' become longer to improve the brightness. This will be described referring to FIG. 11. FIG. 11 shows the structure of the front substrate of the plasma display panel according to the fourth embodiment of the present invention.

Referring to FIG. 11, the black layer 11*c* is formed between the transparent electrode 11*a* and the bus electrode 11*b* on the front substrate 10 of the plasma display panel according to the fourth embodiment of the present invention and also the black layer 11*c* is coated on the whole non-discharge area between a discharge cell A and a discharge cell B on the front substrate 10. In this case, on the front substrate 10 of the plasma display panel according to fourth embodiment of the present invention, the bus electrode 11*b* is formed on the area including a portion of the black layer 11*c* formed on the transparent electrode 11*a* in the discharge cell A and a portion of the black layer 11*c* formed on the non-discharge area in comparison with FIG. 9. The black layer 11*c* is coated on a portion of the transparent electrode 11*a* and the whole non-discharge area as shown in FIG. 9. The bus electrode 11*b* is shifted to be formed on a portion of the non-discharge area on the black layer 11*c*. Accordingly, as shown in FIG. 9, the bus electrode 11*b* is shifted to be formed on a portion of the non-discharge area on the front substrate 10 of the plasma display panel according to the fourth embodiment of the present invention as shown in FIG. 11 so that the interval between the bus electrodes 11*b* and 11*b*' in the discharge cell B is so long as to improve brightness while the bus electrode is formed only on the transparent electrode 11*a* as shown in FIG. 9 so that it is limited to enlarge the interval between bus electrodes formed in a discharge cell.

The method of manufacturing a front panel of the plasma display panel according to the fourth embodiment of the present invention is basically the same as FIG. 9. In the case of manufacturing a front panel 10 of the plasma display panel according to the fourth embodiment of the present invention, when fabricating second photomask 30' to expose the area where bus electrode will be formed, the second photomask 30' should have such a pattern that the bus electrode 11*b* on a portion of transparent electrode and a portion of non-discharge area is exposed. Accordingly, the front substrate 10 that Ag paste is coated on is exposed using the second photomask 30' so that the bus electrode 11*b* can be formed the same as that of the front substrate 10 of the fourth embodiment of the present invention. It is desirable that the black layer 11*c* formed the non-discharge area is a black matrix. The black matrix is formed with the black layer in one at once in fabricating them.

As shown in FIG. 12, on the front substrate of the plasma display panel described above, some experiment is executed to observe how the efficiency, the consuming power and the brightness depends on how much the bus electrode 11*b* is shifted to be formed on the a portion of non-discharge area. The result of the experiment is shown in Table 1.

Figure 12A:
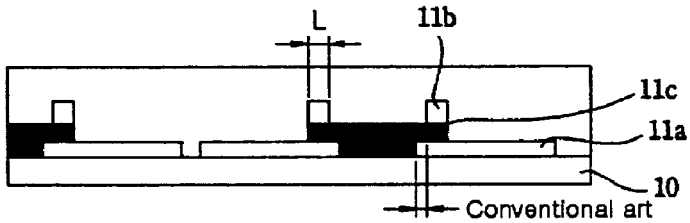
FIGS. 12A though 12F show a bus electrode shifting more and more to a non-discharge area on the front substrate of the plasma display panel of FIG. 11.
Figure 12B:
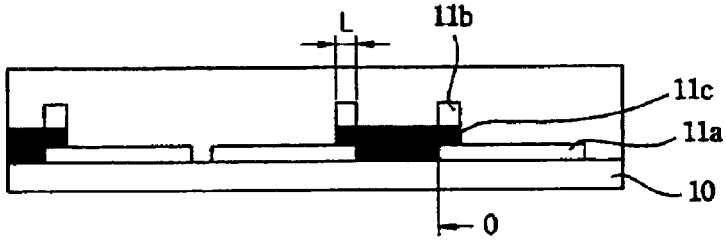
Figure 12C:
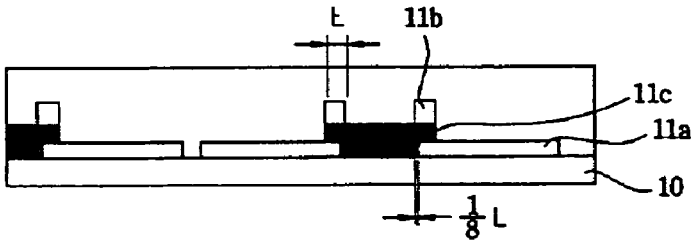
Figure 12D:
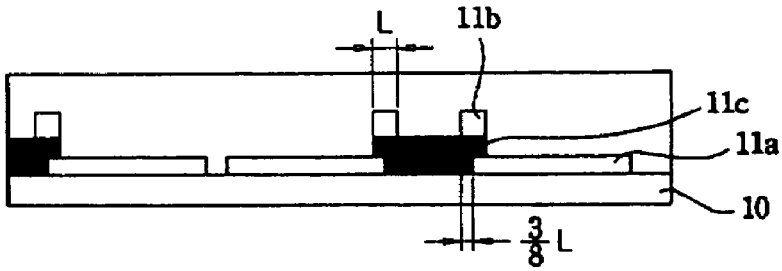
Figure 12E:
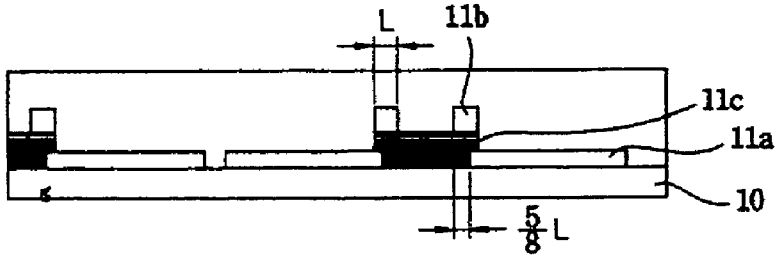
Figure 12F:
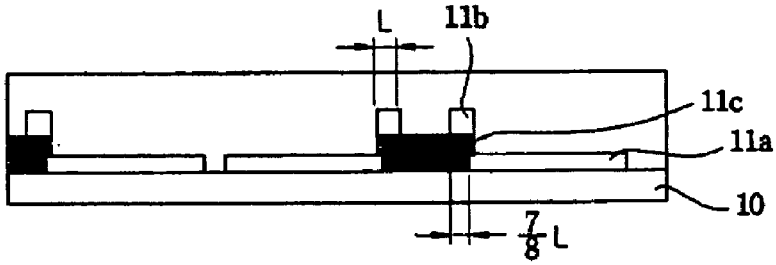

FIG. 12A shows the bus electrode in the related art and FIG. 12B shows a case in which the end of the bus electrode is at the end of the transparent electrode 11*a*. FIGS. 12C through 12F shows the case in which the bus electrode 11*b* is coated on a portion of the non-discharge area more and more. Assuming that the width L of the bus electrode is constant, as shown in FIGS. 12A through 12F, the bus electrode is shifted to the non-discharge area more and more apparently.

TABLE 1

| Location of bus electrode | Efficiency (lm/W) | Consuming power (W) | Brightness (cd/m$^2$) |
|---|---|---|---|
| Prior art (FIG. 12A) | 0.91 | 2.30 | 128 |
| 0 (FIG. 12B) | 1.02 | 2.30 | 149 |
| 1/8L (FIG. 12C) | 1.02 | 2.50 | 155 |
| 3/8L (FIG. 12D) | 1.07 | 2.60 | 170 |
| 5/8L (FIG. 12E) | 1.03 | 2.40 | 185 |
| 7/8L (FIG. 12F) | 0.4 | 10.0 | 230 |

In this case, if the location of the bus electrode is ⅛L, it shows an interval that a portion of the bus electrode is included in a portion of the non-discharge area. In other words, if the width the bus electrode is called 'L', a portion of the bus electrode is formed to shift to the non-discharge area by ⅛L. Note that locations of other bus electrodes mean as the same as described above.

As shown in Table 1, we can find that efficiency, consuming power and brightness are increased as a bus electrode is shifted to a non-discharge area. If the location of a bus electrode is ⅛L, the brightness is not improved very much. If the location of the bus electrode is equal to or more than ⅞L, the brightness is increased greatly but the consuming power is increased too much. Accordingly, if the bus electrode is formed on the non-discharge area in the range of ⅛L~⅝L, all of the efficiency, the consuming power and the brightness are good. Therefore, as the front substrate 10 of the plasma display panel according to the fourth embodiment of the present invention, in the structure in which a black layer 11*c* is formed with the transparent electrode 11*a* in one on a non-discharge area, a portion of a bus electrode is formed to shift to a non-discharge area to improve the brightness.

In other hand, until now fabrication of a black layer and a black matrix in the structure of the front substrate of the plasma display panel. As described above, if the black layer is formed with the black matrix at once or in one, the manufacturing process is simplified to reduce cost of production. When the black layer is formed with the black matrix in one, if a portion of a bus electrode is formed on a non-discharge area, the brightness can be improved.

However, when the black layer is formed with the black matrix in one as described above, if the black layer and the black matrix are formed of black powder of a conventional conductive oxide ruthenium ($RuO_2$), the conductivity of the oxide ruthenium causes short-circuit between the adjacent cells. Accordingly, in the present invention, nonconductive cobalt (Co) based oxides, chromium (Cr) based oxides, manganese (Mn) based oxides, copper (Cu) based oxides, iron (Fe) based oxide, carbon (C) based oxides, etc. instead of conventional conductive ruthenium oxide are used as black powder to form a black layer and a black matrix.

Table 2 shows the result of the experiment in which the thickness of the black layer containing cobalt (Co) based oxide of the conductive oxides is observed varying the thickness. In this experiment, the same process and the same frit glass are employed.

TABLE 2

| Amount of contained frit glass (weight %) | Thickness of film (μm) | Contact resistance (kΩ) (ITO/ BUS electrode) | Initial discharge voltage (V) | Adhesion strength |
|---|---|---|---|---|
| 5 | 0.1 | 4 | 181 | X |
| 10 | 0.3 | 6 | 180 | = |
| 15 | 1.2 | 6 | 182 | ○ |
| 20 | 2.5 | 8 | 182 | ○ |
| 25 | 4.1 | 9 | 182 | ○ |
| 30 | 5.0 | 10 | 185 | ○ |
| 35 | 5.8 | 20 | 261 | ○ |
| 40 | 6.1 | 27 | 267 | ○ |
| 45 | 6.1 | 28 | 267 | ○ |
| 50 | 3.6 | 28 | 268 | ○ |

In Table 2, the adhesion strength is described as ○ (strong), = (middle, X (weak).

The amount of contained frit glass means the amount of frit glass contained in a black paste and the thickness of the black layer depends on the amount of contained frit glass.

Figure 13:
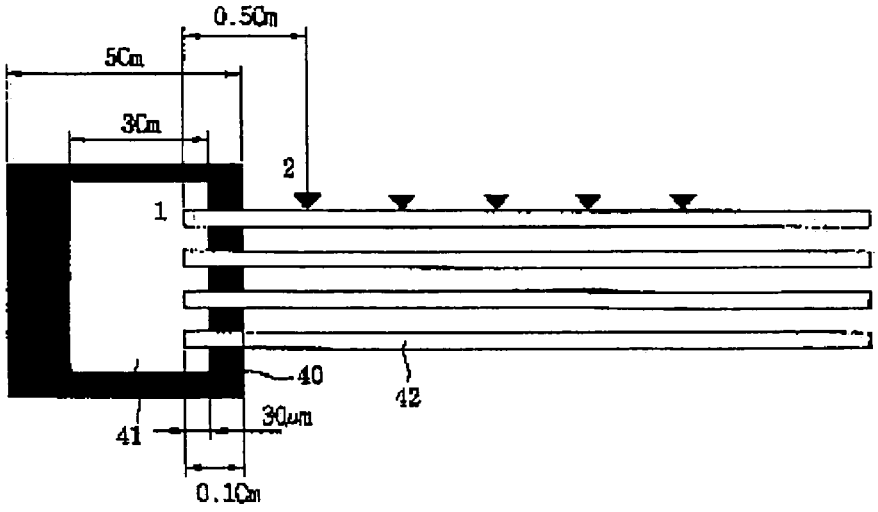
FIG. 13 shows a structure for measurement of the contact resistance of the black layer when manufacturing a front substrate of the plasma display panel according to the first to fourth embodiments of the present invention.

The experiment structure to measure the contact resistance in Table 2 is as shown in FIG. 13. A black layer 40 is formed in the shape of square whose side is 5 cm long and a silver (Ag) electrode 41 is formed on the black layer 40 in the shape of rectangle whose width is 3 cm wide. A transparent electrode 42 is formed to extend from the silver (Ag) electrode 41 and to cross over the black layer 40. Here, the resistance between the location 1 on the silver electrode 41 and the location 2 on the transparent electrode 42 is measured.

As shown in the experiment result table 2, if the amount of the frit glass contained in the black paste is controlled to be 5~30 weight %, the black layer 40 is 0.1~5 cm thick, the contact resistance is 4~10 kΩ and the initial discharge voltage is 180~185 V.

On the contrary, if the amount of the frit glass contained in the black paste is controlled to be equal to or more than 35 weight %, the thickness of the black layer 40 is equal to or more than 5.8 cm, the contact resistance is equal to or more than 20 kΩ and the initial discharge voltage is equal to or more than 261 V.

As a result, if the thickness of the black layer 40 containing the black power of the nonconductive cobalt (Co) based oxide is equal to or less than 5 cm, its contact resistance is equal to or less than 10 kΩ and the conductivity is comparatively so good that the black layer 40 interposed between a transparent electrode 42 and a bus electrode 41 deliver to the bus electrode 41 the current which is flowing to the transparent electrode 42. If the cobalt (Co) based oxide is used to form a black matrix, the black matrix is thicker very much than the black layer and the contact resistance is increased greatly to prevent short-circuit between the adjacent cells from occurring.

In general, ruthenium oxide ($RuO_2$) is expensive but the nonconductive cobalt (Co) based oxides, the chromium (Cr) based oxides, the manganese (Mn) based oxides, the copper (Cu) based oxides, the iron (Fe) based oxide, the carbon (C) based oxides, etc., are comparatively cheap. So, one of such nonconductive oxides is used to form the black layer and the black matrix so that cost of production is reduced.

Figure 14A:
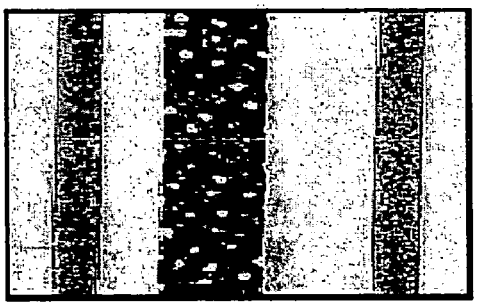
FIGS. 14A and 14B show pin holes and electrode air bubbles generated by frit glass having a softening point of about 425° C.
Figure 14B:
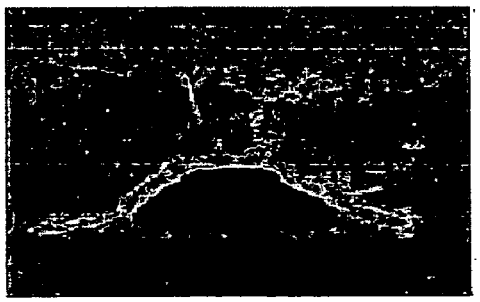

On the other hand, generally a conventional black layer further contains 3-phase based frit glass of $PbO—B_2O_3—SiO_2$ having softening point of about 425° C. as well as ruthenium oxide ($RuO_2$) that is conductive black powder in order to enhance the adhesion strength of the black layer. In this case, if the black layer contains one of the nonconductive oxides and the black layer is thinner than 5 cm, when the 3-phase based frit glass of $PbO—B_2O_3—SiO_2$ having softening point of about 425° C. is applied to the black layer, the adhesion strength is weakened so that many pin holes are generated in the black matrix as shown in FIG. 14A and many air bubbles are generated in the black layer formed between the bus electrode and the transparent electrode 11*a* as shown in FIG. 14B.

Accordingly, in order to prevent the many pin holes and the many air bubbles from being generated, the experiment is executed as shown in following Table 3. One or mixture of 2 or more of $PbO—B_2O_3—Bi_2O_3$, $ZnO—SiO_2—Al_2O_3$ and $PbO—B_2O_3—CaO—SiO_2$ are used as 3-phase based frit glass. When the softening point of the frit glass is adjusted to be 400~580° C., the adhesion strength, pin holes generation and air bubbles generation is observed.

TABLE 3

| Softening point (° C.) of frit glass | Adhesion strength | Pin holes | Electrode air bubbles |
|---|---|---|---|
| 400 | X | ○ | ○ |
| 415 | = | ○ | ○ |
| 430 | = | ○ | ○ |
| 450 | ○ | = | = |
| 480 | ○ | X | X |
| 510 | ○ | X | X |
| 550 | ○ | X | X |
| 580 | X | X | X |

In Table 3, the adheson strength is described as ○ (strong), = (middle), X (weak).

The generation of pin holes and electrode air bubbles is described as O (generating a lot),=(generating not a lot and not a few), X (generating a few).

As shown in Table 3, if the frit glass having a high softening point equal to or more than 450° C. is used, the adhesion strength gets better and the generation of the pin holes and the electrode air bubbles is reduced greatly.

As described above, according to the plasma display panel and the manufacturing method thereof, a black layer formed on a transparent electrode in a discharge cell and a black matrix formed on a non-discharge area are formed in one without any space between them to be coated on the whole non-discharge area. This reduces cost of production and enhances contrast of the plasma display panel. According to the plasma display panel and the manufacturing method thereof of the present invention, each bus electrode in discharge cells is formed to cover the non-discharge areas partially so that bus electrodes in a discharge cell are more spaced from each other. This leads to the brightness improvement.

Specifically, one of nonconductive cobalt (Co) based oxides, chromium (Cr) based oxides, manganese (Mn) based oxides, copper (Cu) based oxides, iron (Fe) based oxide, carbon (C) based oxides that are cheap is used as a black powder to form a black layer and a black matrix so that to reduce the cost of production.

If the nonconductive oxides described above is used and a black layer and a black matrix are formed in one, short-circuit is prevented from being generated.

Even though the description of the preferred embodiment of the present invention is made with examples of cobalt (Co) based oxides as a black powder and $PbO—B_2O_3—Bi_2O_3$, $ZnO—SiO_2—Al_2O_3$ and $PbO—B_2O_3—CaO—SiO_2$ as frit glass, the examples do not limit the present invention and many alternatives, modifications, and variations will be apparent to those skilled in the art. It is obvious that such various alternatives, modifications, and variations are included in the scope of the claim.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method of manufacturing a plasma display panel including: a front substrate; a rear substrate arranged by a predetermined interval from the front substrate; a plurality of sustain electrodes arranged in parallel with each other on the front substrate; a plurality of data electrodes arranged in a direction perpendicular to the plurality of sustain electrodes on the rear substrate; and a plurality of barrier ribs arranged at a constant interval between the front substrate and the rear substrate to partition discharge cells;

the method comprising:

(a) forming a plurality of transparent electrodes in parallel with each other on the front substrate;

(b) coating a black paste on a surface of the front substrate on which the plurality of transparent electrodes are formed, and drying the coated black paste;

(c) exposing an area where a black layer is formed on an area extending from the transparent electrode in one discharge cell to a transparent electrode in an adjacent discharge cell via a non-discharge area between the discharge cells by using a first photomask;

(d) coating a bus electrode paste on the exposed black layer and drying the coated bus electrode paste;

(e) exposing an area where a bus electrode is formed on an area extending from a part of the black layer on the transparent electrode in the one discharge cell to a part of the black layer on the non-discharge area between the discharge cells with a portion of the bus electrode contacting the black layer formed on the non-discharge area having a width ranging from (⅛)L to (⅝)L, where L represents a width of the bus electrode, the exposing of the area where the bus electrode is formed being performed using a second photomask;

(f) developing and annealing the exposed front substrate to form the black layer and the bus electrode; and (g) coating a dielectric paste on the surface of the front substrate on which the black layer and the bus electrode is formed, and drying the coated dielectric paste.

2. The method according to claim 1, wherein the first photomask has a pattern such that the black layer is formed on the area extending from the transparent electrode in the one discharge cell to the transparent electrode in the adjacent discharge cell via the non-discharge area between the discharge cells.

3. The method according to claim 2, wherein the black layer formed on the non-discharge area is a black matrix.

4. The method according to claim 1, wherein the second photomask has a pattern such that the bus electrode is formed to have a same height as the black layer formed on the transparent electrode in the one discharge cell.

5. The method according to claim 1, wherein the black layer includes a black powder made of at least one selected from the group consisting of cobalt (Co) based oxides, chromium (Cr) based oxides, manganese (Mn) based oxides, copper (Cu) based oxides, iron (Fe) based oxide and carbon (C) based oxides.

6. A method of manufacturing a plasma display panel including: a front substrate; a rear substrate arranged by a predetermined interval from the front substrate; a plurality of sustain electrodes arranged in parallel with each other on the front substrate; a plurality of data electrodes arranged in a direction perpendicular to the plurality of sustain electrodes on the rear substrate; and a plurality of barrier ribs arranged at a constant interval between the front substrate and the rear substrate to partition discharge cells, the method comprising:

(a) forming a plurality of transparent electrodes in parallel with each other on the front substrate;

(b) coating a black paste on a surface of the front substrate on which the plurality of transparent electrodes are formed, and drying the coated black paste;

(c) exposing an area where a black matrix is formed on an area extending from the transparent electrode in one discharge cell to the transparent electrode in an adjacent discharge cell via a non-discharge area between the discharge cells by using a first photomask;

(d) coating a bus electrode paste on the exposed black paste and drying the coated bus electrode paste;

(e) exposing an area where a bus electrode is formed on an area extending from a part of a black matrix formed on the transparent electrode in the one discharge cell to a part of the black matrix formed on the non-discharge area by using a second photomask and such that a portion of the bus electrode contacting the black matrix formed on the non-discharge area has a width ranging from (⅛)L to (⅝)L, where L is a width of the bus electrode;

(f) developing and annealing the exposed front substrate to form the black matrix and the bus electrode; and (g) coating a dielectric paste on the surface of the front substrate on which the black matrix and the bus electrode is formed, and drying the coated dielectric paste.

7. The method according to claim 6, wherein the black matrix is formed between the transparent electrode and the bus electrode.

8. The method according to claim 7, the black matrix is formed extending from the transparent electrode formed in the one discharge cell to a part of the non-discharge area between the one discharge cell and the adjacent discharge cell.

9. The method according to claim 7, wherein the black matrix includes a black powder made of at least one selected from the group consisting of cobalt (Co) based oxides, chromium (Cr) based oxides, manganese (Mn) based oxides, copper (Cu) based oxides, iron (Fe) based oxide and carbon (C) based oxides.

10. The method according to claim 6, wherein the black matrix is formed simultaneously with exposing the area where the bus electrode is formed.

11. A method of manufacturing a plasma display panel including: a front substrate; a rear substrate arranged by a predetermined interval from the font substrate; a plurality of sustain electrodes arranged in parallel with each other on the front substrate; a plurality of data electrodes arranged in a direction perpendicular to the plurality of sustain electrodes on the rear substrate; and a plurality of barrier ribs arranged at a constant interval between the front substrate and the rear substrate to partition discharge cells;

the method comprising:

(a) forming a plurality of transparent electrodes in parallel with each other on the front substrate;

(b) coating a black paste on a surface of the front substrate on which the plurality of transparent electrodes are formed, and drying the black paste;

(c) exposing an area where a black layer and a black matrix is formed on an area extending from the transparent electrode in one discharge cell to the transparent electrode in an adjacent discharge cell via a non-discharge area between the discharge cells, the exposing being performed using a first photomask;

(d) coating a bus electrode paste on the exposed black paste and drying the coated bus electrode paste;

(e) exposing an area where a bus electrode is formed on an area extending from a part of the black layer formed on the transparent electrode in the one discharge cell to a part of the black matrix formed on the non-discharge area using a second photomask and such that a portion of the bus electrode contacting the black matrix formed on the non-discharge area has a width ranging from (1/8)L to (5/8)L, where L is a width of the bus electrode;

(f) developing and annealing the exposed front substrate to form the black matrix and the bus electrode; and (g) coating a dielectric paste on the surface of the front substrate on which the black layer and the bus electrode is formed, and drying the dielectric paste.

12. The method according to claim 11, wherein the black layer is formed between the transparent electrode and the bus electrode.

13. The method according to claim 11, wherein the black layer is formed extending from the transparent electrode formed in the one discharge cell to a part of the non-discharge area between the one discharge cell and the adjacent discharge cell.

14. The method according to claim 11, wherein the black layer and the black matrix are concurrently formed.

15. The method according to claim 11, wherein the black layer and black matrix comprises a black powder made of at least one selected from the group consisting of cobalt (Co) based oxides, chromium (Cr) based oxides, manganese (Mn) based oxides, copper (Cu) based oxides, iron (Fe) based oxide and carbon (C) based oxides.

16. The method according to claim 1, wherein the portion of the bus electrode contacting the black layer formed on the non-discharge area has a width of (3/8)L.

17. The method according to claim 1, where the portion of the bus electrode contacting the black layer formed on the non-discharge area has a width ranging from (1/8)L to (3/8)L.

18. The method according to claim 1, where the portion of the bus electrode contacting the black layer formed on the non-discharge area has a width ranging from (3/8)L to (5/8)L.

19. The method according to claim 1, wherein the black layer and the black matrix are concurrently formed.

20. The method according to claim 1, wherein remaining portions of the bus electrode contact the black layer on the one discharge cell.

21. The method according to claim 6, wherein the portion of the bus electrode contacting the black matrix formed on the non-discharge area has a width of (3/8)L.

22. The method according to claim 6, wherein the portion of the bus electrode contacting the black matrix formed on the non-discharge area has a width ranging from (1/8)L to (3/8)L.

23. The method according to claim 6, wherein the portion of the bus electrode contacting the black matrix formed on the non-discharge area has a width ranging from (3/8)L to (5/8)L.

24. The method according to claim 6, wherein remaining portions of the bus electrode contact the black layer on the one discharge cell.

25. A method of manufacturing a display panel comprising:

forming a plurality of transparent electrodes on a substrate of the display panel, the plurality of transparent electrodes including a first transparent electrode in a first discharge cell and having a first edge and a second transparent electrode in a second discharge cell and having a second edge;

forming a black layer extending from on the first transparent electrode in the first discharge cell via a non-discharge area to on the second transparent electrode in the second discharge cell, the non-discharge area being at least between the first edge of the first electrode and the second edge of the second electrode; and providing a first bus electrode on the black layer over the first transparent electrode and the non-discharge area such that a first edge of the first bus electrode is provided over the first transparent electrode and a second edge of the first bus electrode is provided over the non-discharge area.

26. The method according to claim 25, wherein the first edge of the first transparent electrode and the second edge of the first bus electrode are vertically skewed relative to each other.

27. The method according to claim 25, wherein a portion of the first bus electrode contacting the black layer formed on the non-discharge area has a width ranging from (1/8)L to (5/8)L, where L represents a width of the first bus electrode.

28. The method according to claim 27, wherein the portion of the first bus electrode contacting the black layer formed on the non-discharge area has a width of (3/8)L.

29. The method according to claim 27, wherein the portion of the first bus electrode contacting the black layer formed on the non-discharge area has a width ranging from (1/8)L to (3/8)L.

30. The method according to claim 27, wherein the portion of the first bus electrode contacting the black layer formed on the non-discharge area has a width ranging from (3/8)L to (5/8)L.

31. The method according to claim 27, wherein remaining portions of the first bus electrode contact the black layer on the first discharge cell.

32. The method according to claim 25, wherein the black layer comprises a black powder made of at least one selected from the group consisting of cobalt (Co) based oxides, chromium (Cr) based oxides, manganese (Mn) based oxides, copper (Cu) based oxides, iron (Fe) based oxide and carbon (C) based oxides.

33. The method according to claim 25, wherein the black layer formed on the first and second transparent electrodes and the black layer formed on the non-discharge areas between the first and second transparent electrodes are formed at a same time and comprise an integral black layer.

34. The method according to claim 25, wherein a height of the black layer formed on the first transparent electrode is a same height as a height formed on the non-discharge area between the first and second transparent electrodes.

35. The method according to claim 25, further comprising providing a second bus electrode on the black layer over the second transparent electrode and the non-discharge area such that a first edge of the second bus electrode is provided over the non-discharge area and a second edge of the second bus electrode is provided over the second transparent electrode.

36. The method according to claim 35, wherein the second edge of the second transparent electrode and the first edge of the second bus electrode are vertically skewed relative to each other.

37. The method according to claim 36, wherein a portion of the second bus electrode contacting the black layer formed on the non-discharge area has a width ranging from (1/8)L to (5/8)L, where L represents a width of the first bus electrode.

38. The method according to claim 37, wherein the portion of the second bus electrode contacting the black layer formed on the non-discharge area has a width of (3/8)L.

39. The method according to claim 37, wherein the portion of the second bus electrode contacting the black layer formed on the non-discharge area has a width ranging from (1/8)L to (3/8)L.

40. The method according to claim 37, wherein the portion of the second bus electrode contacting the black layer formed on the non-discharge area has a width ranging from (3/8)L to (5/8)L.

41. The method according to claim 37, wherein remaining portions of the second bus electrode contact the black layer on the first discharge cell.

42. A method of providing a display panel comprising:

forming a plurality of transparent electrodes on a substrate of a display panel, the plurality of transparent electrodes including a first transparent electrode having a first edge and a second transparent electrode having a second edge such that a non-discharge area is provided between the first edge and the second edge;

providing a black material on the first transparent electrode, the non-discharge area and the second transparent electrode;

exposing an area of the black material on the first transparent electrode, the non-discharge area and the second transparent electrode;

coating a bus electrode material over the exposed area of the black material;

exposing an area of the bus electrode material extending from on the first transparent electrode to on the non-discharge area so as to form the bus electrode having a first edge and a second edge, the exposing being performed such that the first edge of the bus electrode is provided over the non-discharge area at an area vertically skewed relative to the first edge of the first transparent electrode;

annealing the black material and the bus electrode; and providing a dielectric material on the annealed black material and bus electrode.

43. The method according to claim 42, wherein exposing the area of the bus electrode material includes providing a photomask such that a portion of the bus electrode extending over the non-discharge area has a width ranging from (1/8)L to (5/8)L, where L represents a width of the bus electrode.

44. The method according to claim 43, wherein the portion of the bus electrode over the non-discharge area has a width of (3/8)L.

45. The method according to claim 43, wherein the portion of the bus electrode over the non-discharge area has a width ranging from (1/8)L to (3/8)L.

46. The method according to claim 43, wherein the portion of the bus electrode formed over the non-discharge area has a width ranging from (3/8)L to (5/8)L.

47. The method according to claim 43, wherein remaining portions of the bus electrode contact the black material on the first transparent electrode.

48. The method according to claim 42, wherein the black material formed on the first and second transparent electrodes and the black material formed on the non-discharge areas between the first and second transparent electrodes are formed at a same time and comprise an integral black layer.

* * * * *